US011043113B2

(12) United States Patent
Jensen et al.

(10) Patent No.: US 11,043,113 B2
(45) **Date of Patent: *Jun. 22, 2021**

(54) REMOTE CONTROL DEVICE

(71) Applicant: LEGO A/S, Billund (DK)

(72) Inventors: Jeppe Juul Jensen, Vejle (DK); René Bagnkop Wellejus, Vejle (DK); Kasper Mygind Pedersen, Viby J (DK)

(73) Assignee: LEGO A/S, Billund (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/756,927

(22) PCT Filed: Sep. 5, 2016

(86) PCT No.: PCT/EP2016/070896
§ 371 (c)(1),
(2) Date: Mar. 1, 2018

(87) PCT Pub. No.: WO2017/037302
PCT Pub. Date: Mar. 9, 2017

(65) Prior Publication Data

US 2018/0225958 A1 Aug. 9, 2018

(30) Foreign Application Priority Data

Sep. 4, 2015 (DK) ..... PA 2015 70572

(51) Int. Cl.
*G08C 17/00* (2006.01)
*A63H 30/04* (2006.01)
(Continued)

(52) U.S. Cl.
CPC ..... *G08C 17/00* (2013.01); *A63H 30/04* (2013.01); *A63H 33/042* (2013.01); *G05G 1/10* (2013.01);
(Continued)

(58) Field of Classification Search
CPC G08C 17/00; G08C 2201/30; G08C 2201/90; A63H 30/04; A63H 33/042; G05G 1/10; G01D 5/3473; G01D 5/34738
See application file for complete search history.

(56) References Cited

U.S. PATENT DOCUMENTS 6,340,800 B1 1/2002 Zhai et al.
6,547,624 B1 4/2003 Bojesen et al.
(Continued)

FOREIGN PATENT DOCUMENTS

CN 202654723 U 1/2013
CN 203469479 U 3/2014
(Continued)

OTHER PUBLICATIONS

Danish Search Report issued in DK priority application No. PA 2015 70572, dated Apr. 4, 2016. (Translation unavailable.).
(Continued)

*Primary Examiner* — Franklin D Balseca
(74) *Attorney, Agent, or Firm* — Day Pitney LLP; Valeriya Svystun

(57) ABSTRACT

A remote control device (10) configured for controlling one or more remote controllable actuators (50); said remote control device comprising a housing (11), one or more control units (21), one or more electromechanical interfaces (12) and a transmitter (13); said one or more electromechanical interfaces (12) being positioned inside said housing (11); said one or more control units (21) being functionally connected to said one or more electromechanical interfaces (12) which are functionally connected to said transmitter (13); said one or more control units (21) being structurally connected to said one or more control bases (20), said one or more control bases (20) being arranged rotatable about an axis of rotation (rA) relative to the housing (11) of the remote control device (10) wherein that said one or more
(Continued)

control units (21) together define at least a first and a second functional position (A,B) relative to the one or more control bases, said first and second functional positions (A,B) being located radially on opposite sides of said axis of rotation (rA) of said one or more control bases (20), said one or more control units being configured, regardless of rotation of said one or more control bases (20), to produce a first control signal when activated at said first functional position (A) and to produce a second control signal when activated at said second functional position (B); said first control signal being configured to cause a first function having a first direction associated with it, and said second control signal being configured to cause a second function having a second direction associated with it, and where said second direction is opposite said first direction.

14 Claims, 4 Drawing Sheets

(51) Int. Cl.
*A63H 33/04* (2006.01)
*G05G 1/10* (2006.01)

(52) U.S. Cl.
CPC ..... *G08C 2201/30* (2013.01); *G08C 2201/90* (2013.01)

(56) References Cited

U.S. PATENT DOCUMENTS

| | | | | |
|---|---|---|---|---|
| 6,561,866 | B1 | 5/2003 | Lee | |
| 6,620,022 | B1 | 9/2003 | Smith et al. | |
| 6,753,789 | B1 | 6/2004 | Batra et al. | |
| 6,773,321 | B1 | 8/2004 | Urquiaga | |
| 6,939,192 | B1 | 9/2005 | Munch et al. | |
| 7,105,755 | B2 * | 9/2006 | Imamura | G01D 5/34738 200/11 DA |
| 7,298,311 | B2 * | 11/2007 | Horie | G06F 3/0231 340/815.78 |
| 8,072,427 | B2 * | 12/2011 | Pletikosa | G06F 1/1622 341/22 |
| 2003/0122698 | A1 | 7/2003 | Horie et al. | |
| 2004/0041086 | A1 | 3/2004 | Imamura et al. | |
| 2004/0092207 | A1 | 5/2004 | Hansen | |
| 2004/0137936 | A1 | 7/2004 | Mukaida | |
| 2004/0248500 | A1 | 12/2004 | Hatting | |
| 2006/0025217 | A1 | 2/2006 | Hussaini et al. | |
| 2007/0060393 | A1 * | 3/2007 | Wu | A63F 13/06 463/47 |
| 2008/0146117 | A1 | 6/2008 | Tiburz | |
| 2010/0248583 | A1 | 9/2010 | Lin | |
| 2012/0161946 | A1 | 6/2012 | Ida et al. | |
| 2013/0331002 | A1 | 12/2013 | Amireh | |
| 2015/0360136 | A1 | 12/2015 | Choi | |
| 2016/0129358 | A1 | 5/2016 | Eversoll et al. | |
| 2017/0173485 | A1 | 6/2017 | Liotta et al. | |
| 2018/0224881 | A1 * | 8/2018 | Jensen | A63H 30/04 |

FOREIGN PATENT DOCUMENTS

| | | | |
|---|---|---|---|
| DE | 2856402 | A1 | 7/1980 |
| EP | 0111680 | A2 | 6/1984 |
| EP | 1384500 | A1 | 1/2004 |
| GB | 1277946 | A | 6/1972 |
| WO | 2001097937 | A1 | 12/2001 |
| WO | 2003031007 | A1 | 4/2003 |
| WO | 2009047225 | A1 | 4/2009 |

OTHER PUBLICATIONS

Danish Search Report issued in related DK application No. PA 2015 70571, dated Apr. 4, 2016. (Translation unavailable.).
International Preliminary Report on Patentability issued in corresponding international application No. PCT/EP2016/070896 together with amended sheets of specification and claims, dated Dec. 11, 2017.
International Preliminary Report on Patentability issued in related international application No. PCT/EP2016/070895 together with amended sheets of specification and claims, dated Aug. 28, 2017.
International Search Report issued in related international application No. PCT/EP2016/070895, dated Dec. 5, 2016.
International Search Report issued in corresponding international application No. PCT/EP2016/070896, dated Nov. 21, 2016.
Witten Opinion of the International Searching Authority issued in related international application No. PCT/EP2016/070895, dated Dec. 5, 2016.
Written Opinion of the International Searching Authority issued in corresponding international application No. PCT/EP2016/070896, dated Nov. 21, 2016.
Communication issued in corresponding European application No. EP 16 760 112.9, dated Mar. 15, 2019.
Original Office Action issued in corresponding Chinese application No. CN 201680051307.1, dated Aug. 26, 2019.
English Translation of Office Action issued in corresponding Chinese application No. CN 201680051307.1, dated Aug. 26, 2019.
Non-Final Office Action issued in related U.S. Appl. No. 15/756,939, dated Apr. 16, 2019.

* cited by examiner

REMOTE CONTROL DEVICE

CROSS-REFERENCE TO RELATED APPLICATIONS

This application is a U.S. National Stage of International Application No. PCT/EP2016/070896, filed on 5 Sep. 2016 and published on 9 Mar. 2017, as WO 2017/037302 A1, which claims the benefit of priority to Danish Patent Application No. DK PA201570572, filed on 4 Sep. 2015. The content of each of the above referenced patent applications is incorporated herein by reference in its entirety for any purpose whatsoever.

The present invention relates to a remote control device configured for controlling one or more remote controllable actuators; said remote control device comprising a housing, one or more control units, one or more electromechanical interfaces and a transmitter; said one or more electromechanical interfaces being positioned inside said housing; said one or more control units being functionally connected to said one or more electromechanical interfaces which are functionally connected to said transmitter; said one or more control units being structurally connected to said one or more control bases, said one or more control bases being arranged rotatable about an axis of rotation relative to the housing of the remote control device.

BACKGROUND OF THE INVENTION

Various remote control devices are well known.

The GB patent No. 1277946 disclose a remote control device (1) with two control sticks (12) arranged in a square plate (10) that may be selectively mounted by the user in different angular (90 degree rotation) positions in the housing of the remote control device. The purpose according to this patent is to provide the option of adapting the control stick configuration for controlling different devices such as an airplane, a ship or other remote controllable devices.

In many cases, it is desirable to provide a more child-friendly and more intuitive toy allowing younger children to be able to use a remote control device without the need of technical knowledge of signal transmitters and receivers.

BRIEF DESCRIPTION OF THE INVENTION

It is an object of the invention to provide a remote control device that is easier to use and also enables younger children to independently adapt the remote control device to different purposes and/or uses.

Additionally, an object of the invention is to increases the possible variabilities of play.

This is achieved by said one or more control units together defining at least a first and a second functional position relative to the one or more control bases, said first and second functional positions being located radially on opposite sides of said axis of rotation of said one or more control bases, said one or more control units being configured, regardless of rotation of said one or more control bases, to produce a first control signal when activated at said first functional position and to produce a second control signal when activated at said second functional position; said first control signal being configured to cause a first function having a first direction associated with it, and said second control signal being configured to cause a second function having a second direction associated with it, and where said second direction is opposite said first direction.

This results in increased variability of interaction between a spatial structure and a remote control device. For example, a user may construct a large variety of spatial structures each defining different configurations of the one or more remote controllable actuators, and afterwards adapt the remote control device to the actual use, thus enabling the user to adapt a remote control for different use by changing the configuration or direction of the individual control units arranged in the remote control device simply by rotating the control units.

In an embodiment, said one or more control units are configured for at a given time to produce either said first or said second control signal.

In an embodiment, said one or more control bases have a circular-shaped periphery rotatably arranged in the housing.

In an embodiment, at least part of the circular periphery of said one or more control bases are rotatable within said housing.

In an embodiment, said control bases are rotatable in an axis of rotation which is perpendicular to a plane defined by an outer surface of said housing.

In an embodiment, said one or more control bases are configured for being positioned in any random user-defined angle of rotation.

In an embodiment, the one or more control bases comprise one or more restriction elements, such as a ratchet, the restriction elements being configured to allow the one or more control bases to rotate and be set in 90 degrees intervals on the axis of rotation.

In an embodiment, each control base is structurally connected to one of the one or more electromechanical interfaces, said electromechanical interface comprising at least two coaxially arranged annular rings having different radial diameters, said control bases and said annular rings being arranged coaxially along the axis of rotation.

In an embodiment, the electromechanical interface comprises three coaxially arranged annular rings having a radially increasing diameter to form an inner ring, an intermediate ring and an outer ring.

In an embodiment, each of the one or more control bases comprise one or more control units which are configured to provide at least two functional positions enabling each of the one or more control bases to provide two different sets of data to the transmitter by the control units.

In an embodiment, the one or more control units are shaped as two buttons, a sliding knob or in the form of a tiltable control stick.

In an embodiment, said one or more electromechanical interfaces comprise a coaxially arranged spring element which is configured for structurally connecting said spring element and said coaxially arranged annular rings when an input is provided to said one or more control units.

In an embodiment, said spring element comprises a first and a second set of contact surfaces, said first and second sets of contact surfaces being positioned radially opposite each other in a distance from the axis of rotation, the first set of contact surfaces are configured for abutting said inner annular rings and said intermediate annular rings, respectively, and said second set of contact surfaces are configured for abutting said intermediate and outer annular rings.

In an embodiment, the remote control device comprises 1-10 control bases, preferably 1, 2, 4 or 6 control bases.

BRIEF DESCRIPTION OF THE INVENTION

Embodiments of the invention will be described in the following with reference to the drawings wherein FIG. 1 is perspective view of a remote control device, FIG. 2 is a perspective view of a signal receiver, FIG. 3 is a perspective view of a signal receiver with an integrated remote controllable actuator, FIG. 4 is a perspective view of a remote control device comprising a control base with control units illustrating change of polarity, FIG. 5 is a perspective view of a remote control device comprising a control base with control units illustrating chancing direction (90 degrees clockwise), FIG. 6 is a perspective view of a remote control device comprising a control base with control units illustrating changing direction to a random user-defined direction, FIG. 7 is a split sectional view of the housing, a control base and an electromechanical interface, FIG. 8 is a sectional view of a control base with a tiltable control unit, FIG. 9 illustrates a part of an electromechanical interface in a perspective view, FIG. 10 is a side view of a control unit and an electromechanical interface, and FIG. 11 illustrates different embodiments of a control unit.

DETAILED DESCRIPTION OF THE INVENTION WITH REFERENCE TO THE FIGURES

The present invention relates to a remote control device.

Various aspects and embodiments of a remote control device for communicating control signals to a remote controllable actuator (50) disclosed herein will now be described with reference to the figures.

When relative expressions such as "upper" and "lower", "in front" and "in back", clockwise" and "counter clockwise" or similar are used in the following, these only refer to the appended figures and not to an actual situation of use.

The remote control device (10) illustrated in FIG. 1 comprises a housing (11) and one control base (20) and two control units (21) in the form of two buttons A and B.

A user may activate the remote control device by activating a control unit (21), such as pressing the button A so as to provide a control signal to be communicated from the remote control device via the transmitter (13) to a remote controllable actuator (50).

The transmitter (13) is configured for communicating a control signal to be read by a receiver (31) of a registration unit (30), which is illustrated in FIGS. 2 and 3.

The transmitter (13) is configured for communicating control signals to be read by a receiver (31), said receiver (31) being functionally connected to the one or more remote controllable actuators; thus, the remote control device is configured for controlling the one or more remote controllable actuators (50).

In FIG. 2 the registration unit (30) comprises a receiver (31). The registration unit (30) is connected to a remote controllable actuator (50) via an external cable connection (40). This connection may be in form of a wireless connection. In the illustrated embodiment the registration unit (30) and the remote controllable actuator (50) are individual, separated units. The remote controllable actuator (50) provides a rotatable motion (R) to a rotatable shaft in a clockwise direction.

In FIG. 3 the registration unit (30) and the remote controllable actuator (50) are illustrated as one structural unit. The registration unit (30) comprises a receiver (31) and the registration unit (30) is connected functionally to the remote controllable actuator (50) via an internal cable or wireless connection. The remote controllable actuator (50) is illustrated as providing a clockwise rotating movement (R).

A user may adapt the remote control device to the actual use, FIGS. 4-6 illustrate different examples of adaptions.

Generally, the control base (20) may comprise a marking, such as a dot as illustrated in FIG. 1, to indicate the orientation of the control base (20).

FIG. 4 illustrates the change of polarity. An example, the remote control device is used for driving a structure, such as a vehicle, where a remote controllable actuator (50) is used for turning the wheel of the vehicle. As the user presses the control unit (21) in form of the button A, which is located in the front of the remote control device, the vehicle moves backwards, and when pressing the button B, which is located at the back of the remote control device, the vehicle drives forward.

This is illogical for the user and instead of deconstructing and reconstructing the vehicle comprising the remote controllable actuator (50), the user wants to adapt the remote control device.

The remote control device (10) is adapted to the specific use by simply turning the rotatable control base (20) 180 degrees clockwise around the axis of rotation (rA) for changing direction.

After rotation of the control base (20) the user has changed the behavior of the remote control. Now the two control units (21) in form of the buttons A and B have swapped positions, button B is located in the front, and when pressing the button B, the vehicle moves forward, and likewise as button A is now located in the back, the vehicle more logically moves backward, when the button A is pressed.

FIG. 5 illustrates change of direction. A similar example as above, a structure, such as a vehicle, is constructed by toy building elements, and a controllable activator (50) is connected to the wheels. When the user presses the control input (21), in the form of the button A, which is located in the front of the remote control device, the vehicle turns left, and not as expected in a forward motion.

To change this, the user can turn the control base (20) including the two control units (21) 270 degrees clockwise around the axis of rotation (rA); such that the control unit (21) in form of the button A is oriented in the left direction.

After rotating the control base (20) and the control unit (21), the user has changed the behavior of the remote control device. Now, when pressing the button A, which is now positioned to the left on the remote control device (10), the vehicle steers to the left.

In the illustrated embodiments the control base (20) can rotate freely, both clockwise and counterclockwise. However, the one or more control bases (20) may comprise one or more restriction elements, such as a ratchet, which restricts movement in one direction and allows movement in the opposite direction, by means of angled teeth in which a pawl, cog or tooth engages, allowing motion in one direction only. The restriction elements may be configured to allow the one or more control bases (20) to rotate and be set in 90 degrees intervals around the axis of rotation (rA).

FIG. 6 illustrates a user defined change of angle of rotation.

Generally, the one or more control bases (20) are arranged rotatable about an axis of rotation (rA) relative to the housing (11) of the remote control device (10). The one or more control units (21) together define at least a first and a second functional position (A,B) radially on opposite sides of the axis of rotation (rA) of the one or more control bases (20).

The one or more control units (21) are configured, regardless of rotation of the one or more control bases (20), to produce a first control signal when activated at the first functional position (A) and to produce a second control signal when activated at the second functional position (B). The first control signal are configured to cause a first function having a first direction associated with it, and the second control signal are configured to cause a second function having a second direction associated with it, and where the second direction is opposite the first direction.

The term "direction" is meant to refer to any direction which can be described as a vector, for instance a movement forwards/backwards, up/down, slow/fast, high/low, left/right, and "a function having a direction associated with it" is meant to refer to functions such as a car driving forwards or backwards or turning up or down the volume of a sound or changing the brightness of a light.

FIG. 7 is a split sectional view of the housing (11), the control base (20) and an electromechanical interface (12). The electromechanical interfaces (12) comprise a spring element (24) and three annular rings (27).

The control base (20) is rotatable around the axis of rotation (rA), and the axis of rotation (rA) is perpendicular to a plane defined by the upper surface of the housing (11).

The electromechanical interface (12) comprises three coaxially arranged annular rings (27) having different radial diameters positioned in the same plane. The control bases (20) and the annular rings (27) are arranged coaxially along the axis of rotation (rA). The three coaxially arranged annular rings (27) have different radial diameters, such as to form an inner annular ring, an intermediate annular ring and an outer annular ring. The inner annular ring, the intermediate annular ring and the outer annular ring are positioned in a plane perpendicular to the axis of rotation (rA).

Generally, in some embodiments, the electromechanical interface (12) may comprise more than three annular rings (27), such as four annular rings, in order to provide additional regulation steps for the remote control device.

The control unit (21) comprises a protrusion (23) located on the axis of rotation (rA), whereon the control unit (21) and the spring element (24) may pivot allowing the end portions of the spring element (24) to engage with the annular rings (27).

All the components are arranged coaxially along the axis of rotation (rA).

The control unit (21) may comprise coupling means (22) in form of an x-shaped aperture for allowing a toy building element to be coupled to the control unit, such as a shaft, to form a tiltable control stick.

FIG. 8 illustrates that the control unit (21) is structurally connected to the control base (20), such that when the control base (20) is rotated in the housing, the control unit (21) also rotates.

Figure 1:
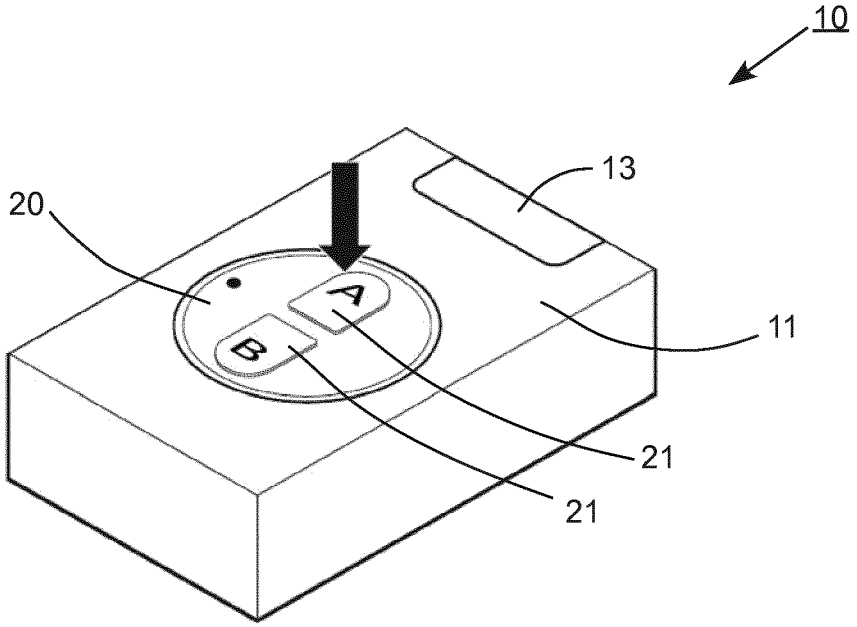
Figure 2:
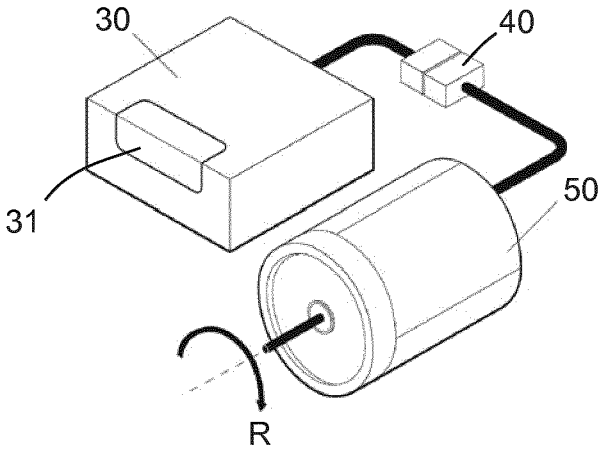
Figure 3:
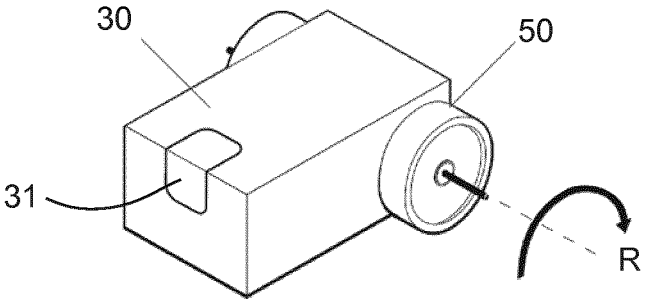
Figure 4:
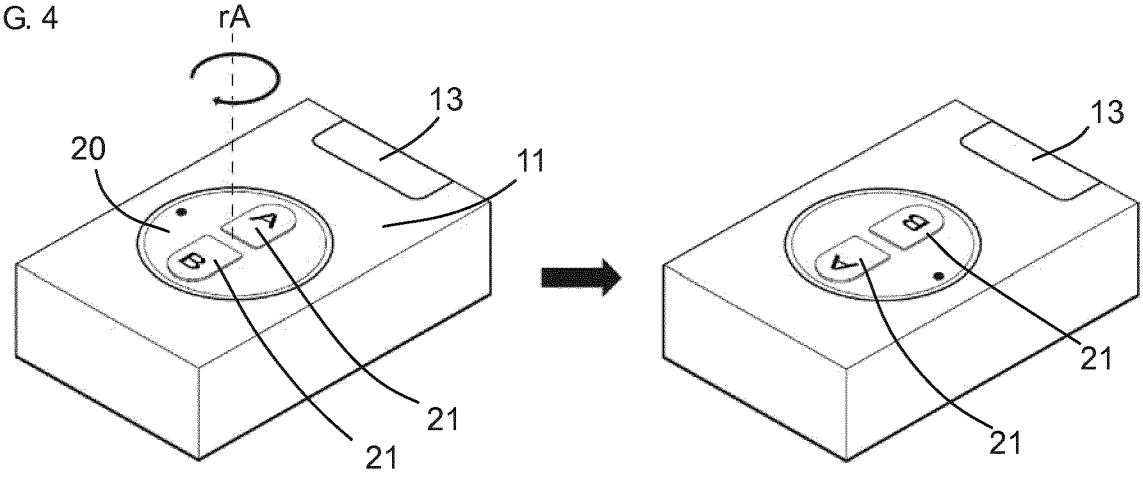
Figure 5:
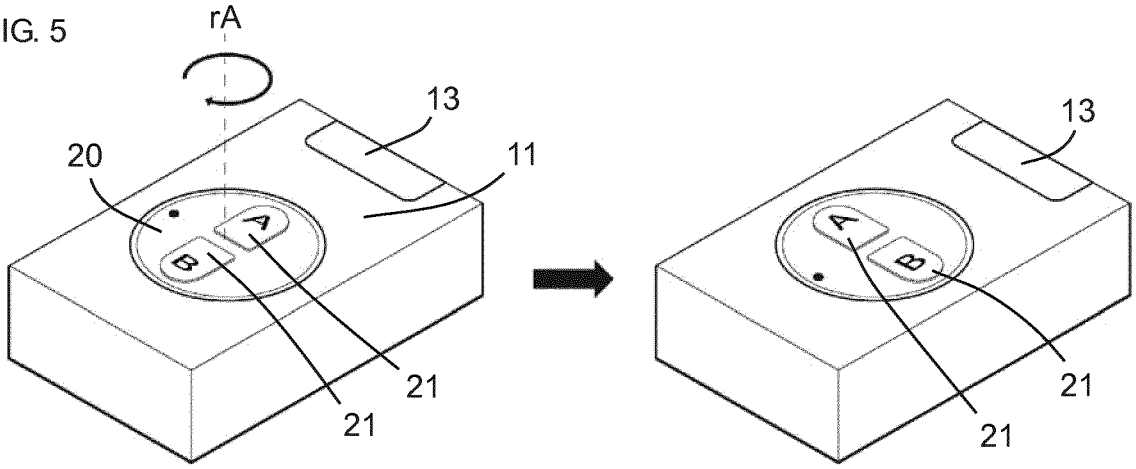
Figure 6:
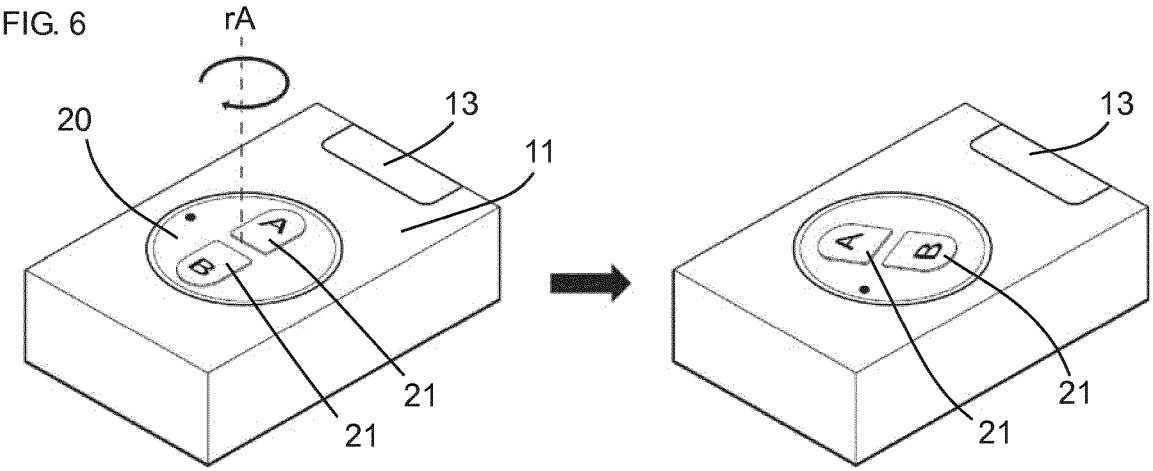
Figure 7:
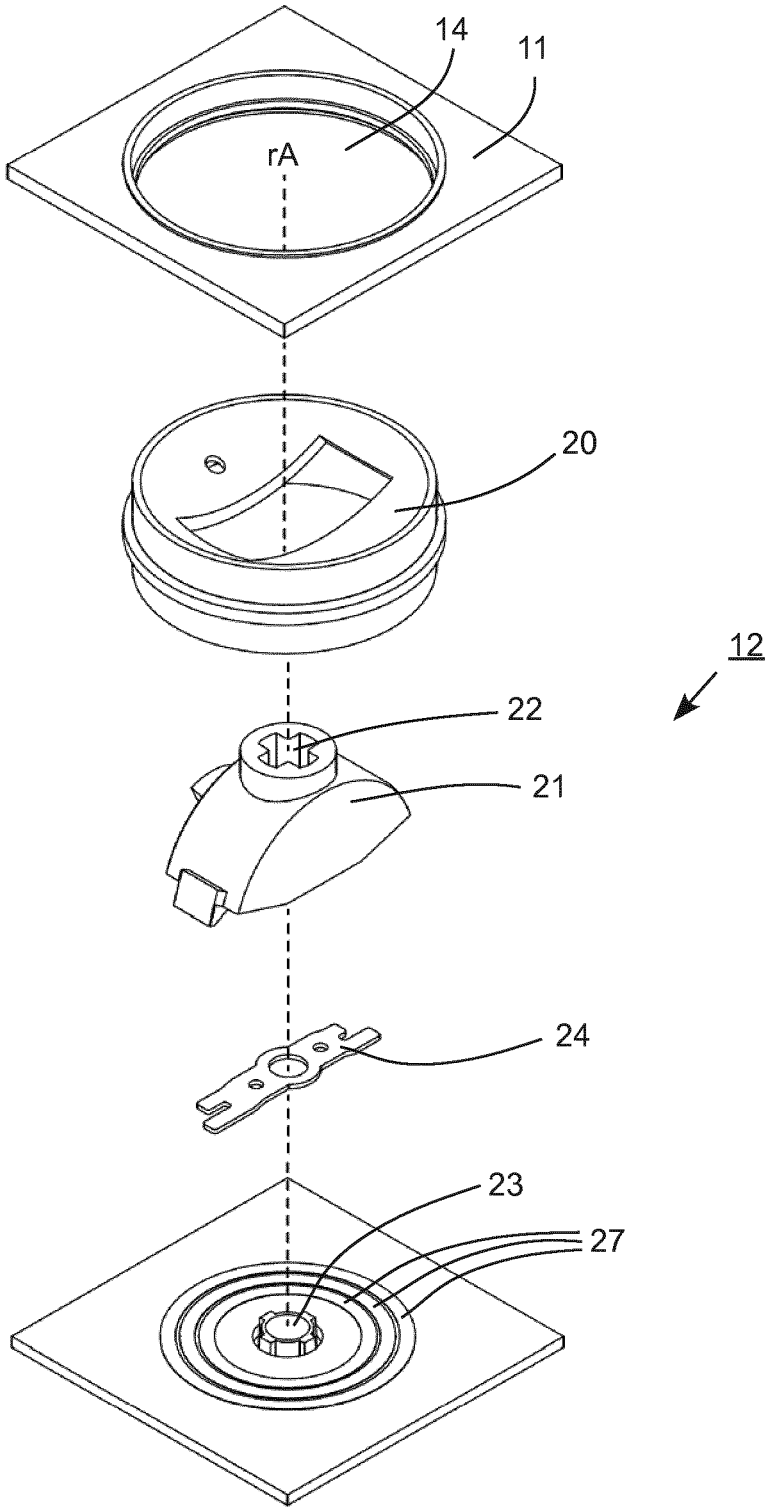
Figure 8:
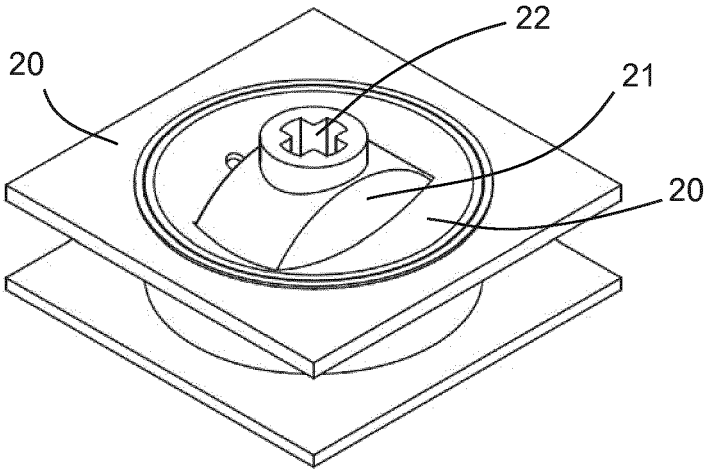
FIG. 8 shows a perspective view of the components shown in FIG. 7, when assembled.
Figure 9:
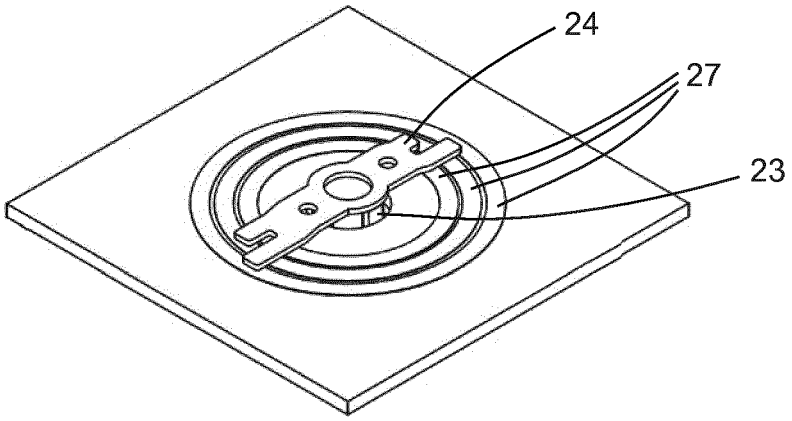
FIG. 9 shows, in a perspective view, the lower part of the electromechanical interface. The electromechanical interfaces (12) comprise a spring element (24) and three annular rings (27).
Figure 10:
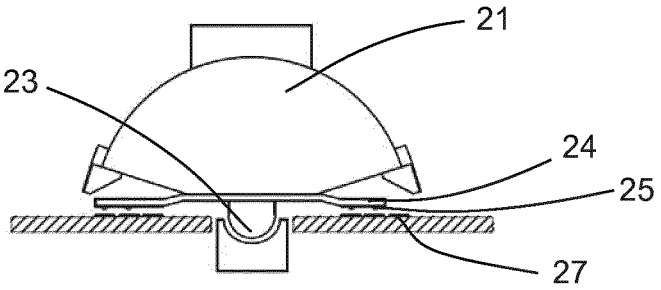
Figure 11:
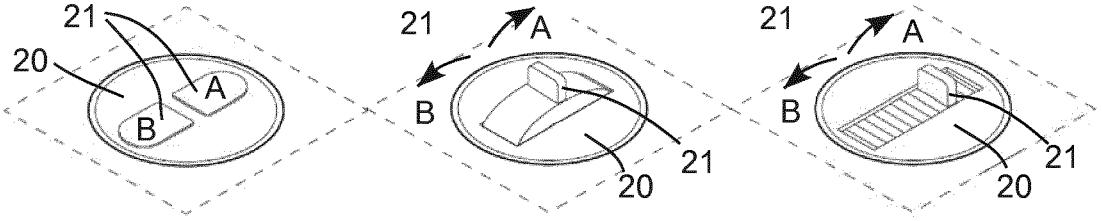

A side view of the control unit (21) and the electromechanical interface, as shown in FIG. 9, is shown in FIG. 10.

The spring element (24) comprises a first and a second set of contact surfaces (25). The first and second sets of contact surfaces (25) are positioned radially opposite each other in a distance from the axis of rotation (rA). The first set of contact surfaces are configured for abutting the inner ring and the intermediate annular ring (27), respectively, and the second set of contact surfaces (25) are configured for abutting the intermediate and the outer annular ring (27). The centrally positioned protrusion (23) allows the spring element (24) to pivot and the end portions of the spring element to connect with the annular rings (27) with the first or the second sets of contact surfaces (25), respectively. The contact surfaces (25) are arranged in the same distance as the annular rings (27) from the axis of rotation (rA) such that the contact surfaces (25) are aligned with the annular rings (27) to allow engagement. The engagement will be possible regardless of the orientation of the control base (20) and the control unit (21).

The control unit (21) comprises a protrusion (23) located on the axis of rotation (rA), whereon the control unit (21) and the spring element (24) may pivot allowing the control unit (21) to provide two different sets of data to the transmitter (13). By activating the control units (21), the spring (24) pivots and engages with the annular rings (27), with the first or the second sets of contact surfaces (25), respectively.

In FIGS. 8-11 the control base (20) comprises one or two control units (21) which are configured to provide two functional positions (A,B) enabling each control base (20) to provide two different sets of data to the transmitter (13) by the control units (21).

The one or two control units (21) together define at least a first and a second functional position (A,B) radially on opposite sides of the axis of rotation (rA) of the control base (20).

The one or more control units (21) are configured, regardless of the rotation of the one or more control bases (20), to produce a first control signal when activated at the first functional position (A) and to produce a second control signal when activated at the second functional position (B). The first control signal is configured to cause a first function having a first direction associated with it, and the second control signal is configured to cause a second function having a second direction associated with it, and where the second direction is opposite the first direction.

Typically, each of the one or more control bases (20) comprise one or more control units (21) which are configured to provide at least two functional positions (A,B) enabling each of the one or more control bases (20) to provide two different sets of data to the transmitter (13) by the control units (21). The three different embodiments shown in FIG. 11 comprise two buttons, a tiltable control stick and a sliding knob, respectively, each embodiment providing two functional positions (A,B).

The invention claimed is:

1. A remote control device configured for controlling one or more remote controllable actuators, said remote control device comprising:

a housing, one or more control units, an electromechanical interface, and a transmitter;

said electromechanical interface being positioned inside said housing;

said one or more control units being functionally connected to said electromechanical interface which is functionally connected to said transmitter;

said one or more control units being structurally connected to one or more control bases;

wherein said one or more control units together define at least a first and a second functional position relative to the one or more control bases, said first and second functional positions being located radially on opposite sides of an axis of rotation of said one or more control bases;

said one or more control units being configured to produce a first control signal when activated at said first functional position and to produce a second control signal when activated at said second functional position; and said electromechanical interface comprising a coaxially arranged spring element which is configured for structurally connecting to said one or more control units, and a first and a second annular rings concentric about the axis of rotation;

wherein said spring element crosses the axis of rotation and comprises a first and a second contact surfaces positioned on said spring element and on opposite sides of the axis of rotation and making selective electromechanical contact with not more than one of said first and second annular rings; and wherein contact of the spring element with the first annular ring enables the second control signal.

2. The remote control device according to claim 1, wherein said one or more control bases are configured for being positioned in any random user-defined angle of rotation.

3. The remote control device according to claim 1, wherein the one or more control bases comprise one or more restriction elements, the one or more restriction elements being configured to allow the one or more control bases to rotate and be set in 90 degrees intervals on the axis of rotation.

4. The remote control device according to claim 1, wherein said one or more control units are configured for at a given time to produce either said first or said second control signal.

5. The remote control device according to claim 1, wherein said one or more control bases have a circular-shaped periphery rotatably arranged in the housing.

6. The remote control device according to claim 5, wherein at least part of the circular periphery of said one or more control bases is rotatable within said housing.

7. The remote control device according to claim 1, wherein said one or more control bases are rotatable in an axis of rotation which is perpendicular to a plane defined by an outer surface of said housing.

8. The remote control device according to claim 7, wherein the electromechanical interface comprises three coaxially arranged annular rings having a radially increasing diameter to form an inner ring, an intermediate ring and an outer ring.

9. The remote control device according to claim 8, the first contact surface being configured for abutting an inner annular ring of the electromechanical interface and an intermediate annular ring of the electromechanical interface, and said second contact surface being configured for abutting said intermediate annular ring of the electromechanical interface and an outer annular ring of the electromechanical interface.

10. The remote control device according to claim 1, wherein each of the one or more control bases is structurally connected to the electromechanical interface, said electromechanical interface comprising at least two coaxially arranged annular rings having different radial diameter, said one or more control bases being arranged coaxially along the axis of rotation with annular rings of the electromagnetic interface.

11. The remote control device according to claim 1, wherein each of the one or more control bases comprises one or more of the one or more control units which are configured to provide at least two functional positions enabling each of the one or more control bases to provide two different sets of data to the transmitter by the one or more control units.

12. The remote control device according to claim 1, wherein the one or more control units are shaped as two buttons, a sliding knob or in a form of a tiltable control stick.

13. The remote control device according to claim 1, wherein the remote control device comprises 1-10 control bases.

14. The remote control device according to claim 13, wherein the remote control device comprises an even number of control bases.

* * * * *